US006565015B2

(12) United States Patent
Leer et al.

(10) Patent No.: US 6,565,015 B2
(45) Date of Patent: May 20, 2003

(54) PORTABLE SELF-ENERGIZING PRESSURE SPRAYER

(75) Inventors: Rick L. Leer, Somerset, PA (US); Scott A. Walker, Somerset, PA (US)

(73) Assignee: Gilmour, Inc., Newark, DE (US)

( * ) Notice: Subject to any disclaimer, the term of this patent is extended or adjusted under 35 U.S.C. 154(b) by 0 days.

(21) Appl. No.: 09/800,791

(22) Filed: Mar. 7, 2001

(65) Prior Publication Data

US 2001/0038041 A1 Nov. 8, 2001

Related U.S. Application Data

(60) Provisional application No. 60/189,194, filed on Mar. 14, 2000.

(51) Int. Cl.[7] ..... B05B 17/00; B05B 9/00; B05B 9/06

(52) U.S. Cl. ..... 239/157; 239/124; 239/155; 239/147; 239/1

(58) Field of Search ..... 239/124, 1, 302, 239/337, 355, 360, 363, 373, 722, 147, 155, 157

(56) References Cited

U.S. PATENT DOCUMENTS

| | | | | | |
|---|---|---|---|---|---|
| 4,227,649 | A | * | 10/1980 | Poffenroth | 239/124 |
| 4,333,609 | A | * | 6/1982 | Backo | 239/124 |
| 4,508,248 | A | * | 4/1985 | Ridgeon | 222/623 |
| 4,650,124 | A | * | 3/1987 | Connaughty et al. | 239/708 |
| 4,798,333 | A | * | 1/1989 | Luchsinger | 239/142 |
| 5,195,308 | A | * | 3/1993 | Grote et al. | 56/16.4 |
| 5,613,371 | A | * | 3/1997 | Nelson | 62/244 |

FOREIGN PATENT DOCUMENTS

FR 2315228 A * 6/1975 ..... A01C/23/04

OTHER PUBLICATIONS

"Spray Pal™" Assembly Insructions, 4 pages.
Craftsman brochure titled "Wheel 'N Spray Garden & Deck Sprayer" by Sears, Roebuck and Co., 2 pages.
Wheel Spray Corporation literature entitled "Motorless Liquid Chemical Spreader, WS–490 Greens Wheelie", 3 pp.
Wheel Spray Corporation literature from website http://www.wheelspray.com showing various motorless ground-driven sprayers, 6 pages.

* cited by examiner

*Primary Examiner*—Michael Mar
*Assistant Examiner*—Davis Hun
(74) *Attorney, Agent, or Firm*—Maginot, Moore & Bowman

(57) ABSTRACT

A pressure sprayer is pressurized automatically with movement of the sprayer and maintains adequate pressure during non-movement to allow the ejection of an amount of liquid before needing re-pressurization. The pressure sprayer includes wheels that allow the pressure sprayer to be mobile. A cam is attached to the axle of the wheels which rotates with the rotation of the axle/wheels. A pressure pump is associated with the cam such that movement of the cam causes the pressure pump to pump liquid from a holding tank to an accumulator or directly to a spray wand in communication with the pump. The liquid may be sprayed (ejected) from the accumulator during both movement (pumping) and non-movement (no pumping) of the sprayer, while the liquid may be directly sprayed from the holding tank only during movement (pumping) thereof. Thus, as the wheels rotate due to moving the pressure sprayer, the cam causes movement of the pressure pump to fill the accumulator with the liquid under pressure. The pressure pump is adapted to obtain liquid from the holding tank and provide that liquid to the pressure accumulator. A relief valve is provided to relieve the buildup of pressure during movement of the wheels when no spraying is taking place.

25 Claims, 17 Drawing Sheets

PORTABLE SELF-ENERGIZING PRESSURE SPRAYER

This non-provisional U.S. patent application claims the benefit of U.S. provisional patent application serial No. 60/189,194, filed on Mar. 14, 2000.

FIELD OF THE INVENTION

The present invention relates to pressure sprayers and, more particularly, to portable, self-pumping pressure sprayers.

BACKGROUND OF THE INVENTION

Pressure sprayers are well known in the art, having been developed many years ago. They essentially consist of a tank that is adapted to hold a liquid and become pressurized with air. The tank becomes pressurized via a pump. When a spray head and/or wand that is attached to the pressurized tank is opened, the liquid within the tank is ejected from the spray head/wand by the pressure in the tank. Eventually, the pressure within the tank decreases with the ejection of liquid therefrom. When the pressure against the liquid within the tank drops to a particular value, the liquid will not be ejected from the tank due to lack of pressure. Therefore, in order to maintain (have) adequate pressure within the tank in order to eject the liquid therefrom, the pressure must be periodically increased. This is accomplished by a manually actuated pump associated with the pressure sprayer.

Such pressure tanks may be used for spraying insecticides, pesticides, biocides, and herbicides, as well as paints, stains, water, and virtually any other non-viscous liquid. Small, portable (i.e. hand-carried) pressure tanks of one to five gallons in size have been used by the home and business industry. Early pressurized tanks were metal canisters with a manually actuated pump. When these metal tanks were filled with a liquid, and manually pumped to the appropriate pressure, they were quite heavy and cumbersome to carry. Currently, most pressure sprayers are formed from a suitable plastic. While plastic tanks are lighter than metal tanks when filled with a liquid and pumped to an adequate pressure, they are still cumbersome and somewhat heavy.

Wheels were added to larger pressure sprayers in order to alleviate the above problems by allowing a user to pull or push the pressure sprayer to its intended location rather than carry the pressure sprayer. These portable pressure sprayers were, however, still pressurized by manually actuated pumps. Thus, although these mobile pressure sprayers obviated the need to carry the heavy pressure sprayers, they were still pressurized by manual pumps.

Still another type of wheeled pressure sprayer in existence includes a pump which is actuated by rotation of the wheels of the sprayer. Upon actuation, the pump generates pressure which causes fluid to be sprayed out of the tank of the sprayer. However, this type of sprayer does not store pressure for spraying when the sprayer is not being moved (i.e. when the wheels are not being rotated). In other words, when movement of the sprayer is stopped so that the wheels are no longer rotating, the sprayer stops pumping fluid from the tank of the sprayer to the environment (e.g. onto a lawn).

What is needed is a portable pressure sprayer that develops its own pressure for ejecting a liquid and stores such pressure for later use by the sprayer even when the wheels of the sprayer are no longer being rotated.

What is further needed is a portable pressure sprayer that develops it own pressure for ejecting a liquid wherein adequate ejection pressure is maintained at least transiently.

What is still further needed is a portable pressure sprayer that develops pressure for ejecting a liquid through movement of the pressure sprayer, wherein adequate pressure is maintained for liquid ejection during periods of non-movement (i e. during periods when the wheels of the sprayer are no longer being rotated).

SUMMARY OF THE INVENTION

The present invention is a self-energizing pressure sprayer in which movement of the sprayer creates and maintains adequate pressure to expel an amount of liquid held therein during both movement and non-movement of the sprayer.

In one form thereof, a pressure sprayer having a holding tank includes a pressure pump that is adapted to pump a liquid from the holding tank to the accumulator during movement of the sprayer (i.e. rotation of the wheels of the sprayer).

In another form thereof, a pressure sprayer includes a holding tank, an accumulator and a pressure pump in communication with the holding tank and the accumulator. The pressure sprayer further includes wheels carried on an axle that rotates during pushing and/or pulling movement of the pressure sprayer. The pressure pump is associated with the axle such that rotation of the axle causes the pressure pump to pump fluid from the holding tank to the accumulator wherein the fluid is pressurized for ejection from the sprayer even at times when the wheels of the sprayer are being maintained stationary.

In yet another form thereof, a pressure pump of a pressure sprayer having a holding tank and an accumulator both in fluid communication with the pressure pump, is coupled to a cam assembly affixed on an axle for wheels of the pressure sprayer that drives the pressure pump during pushing and/or pulling movement of the pressure sprayer. The pump is in communication with a tank adapted to hold a liquid to be ejected and a pressure accumulator. During movement of the pressure sprayer, the cam assembly rotates to cause the pressure pump to reciprocate and thus pump (operate). Once the pressurized fluid has been depleted, movement of the pressure sprayer re-energizes (re-pressurizes) fluid for ejection.

According to still another embodiment of the present invention, there is provided a pressure sprayer which includes a tank for holding fluid, and an accumulator for storing fluid therein under pressure. The sprayer further includes a number of wheels for supporting the tank. Moreover, the sprayer includes a pump which advances fluid from the tank into the accumulator in response to rotation of the number of wheels. The pressure within the accumulator is increased when fluid is advanced into the accumulator by the pump.

Yet in accordance with another embodiment of the present invention, there is provided a pressure sprayer which includes an accumulator for storing fluid therein under pressure, and at least one wheel which rotates when the pressure sprayer is moved. The sprayer also includes a pump which advances fluid into the accumulator in response to rotation of the at least one wheel. An increased pressure is generated within the accumulator in response to fluid being advanced into the accumulator by the pump. Further, the increased pressure within the accumulator is maintained when the at least one wheel is stationary.

In accordance with still another embodiment of the present invention, there is provided a method of spraying fluid with a portable pressure sprayer having a tank, an accumulator, and a number of wheels. The method includes the steps of (i) moving the portable pressure sprayer so as to cause the number of wheels to rotate, (ii) advancing fluid from the tank into the accumulator in response to rotation of the number of wheels, (iii) generating an increased pressure within the accumulator in response to fluid being advanced into the accumulator, and (iv) maintaining the increased pressure within the accumulator after the moving step when the number of wheels are stationary.

In accordance with yet another embodiment of the present invention, there is provided a method of spraying fluid with a pressure sprayer having at least one wheel. The method includes the step of moving the portable pressure sprayer so as to cause the at least one wheel to rotate. The method also includes the step of generating an increased pressure within the sprayer in response to rotation of the at least one wheel. In addition, the method includes the step of maintaining the increased pressure within the sprayer after the generating step when the at least one wheel is stationary.

BRIEF DESCRIPTION OF THE DRAWINGS

The above-mentioned and other features and advantages of this invention, and the manner of attaining them, will become more apparent and the invention will be better understood by reference to the following description of embodiment(s) of the invention taken in conjunction with the accompanying drawings, wherein.

Corresponding reference characters indicate corresponding parts throughout the several views. The exemplification set out herein illustrates a preferred embodiment of the invention, and such exemplification is not to be construed as limiting the scope of the invention in any manner.

DETAILED DESCRIPTION OF THE INVENTION

Figure 1:
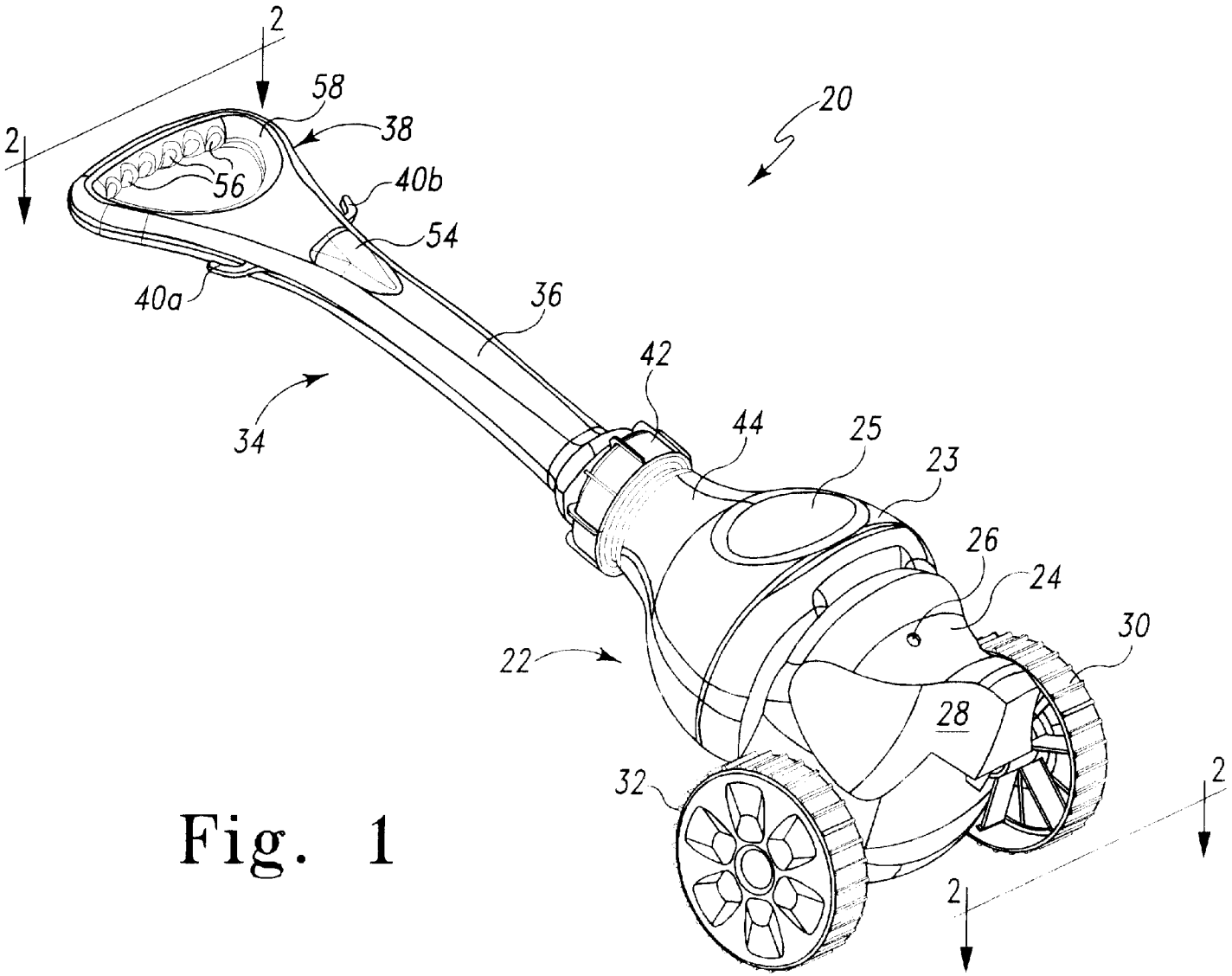
FIG. 1 is a perspective view of a design of a mobile pressure sprayer embodying various features in accordance with the principles of the invention set forth herein.

Referring now to the drawings and, more particularly to FIG. 1, there is shown a pressure sprayer generally designated 20. In the current best mode, the pressure sprayer 20 is formed (e.g. molded) from a suitable plastic that is durable, able to withstand air pressure stress, and other stresses of use. Various thermoplastics may be used such as polyethylene, polypropylene, nylon, and the like. It should be appreciated that one type of plastic may be used for one component of the pressure sprayer 20 while another type of plastic may be used for other components. The pressure sprayer 20 includes a main body or housing 22 defined by an upper or tank portion 23 and a lower or support portion 24. The tank 23 has a label area 25 on which may be placed an identifying and/or warning label as necessary.

The lower portion 24 supports the tank portion 23 and is itself movably supported by wheels 30 and 32. The wheels 30 and 32 are preferably molded from a suitable plastic and include a plurality of ridges along the periphery or diameter of the wheel. The lower portion 24 also includes a hose bore 26 and a support 28. The support 28 provides a drain housing and serves as one leg in a tri-pod configuration defined by the wheels 30 and 32 and the support 28. The hose bore 26 allows a sprayer hose to extend from the interior of the body 22 to an exterior of the body 22.

Figure 2:
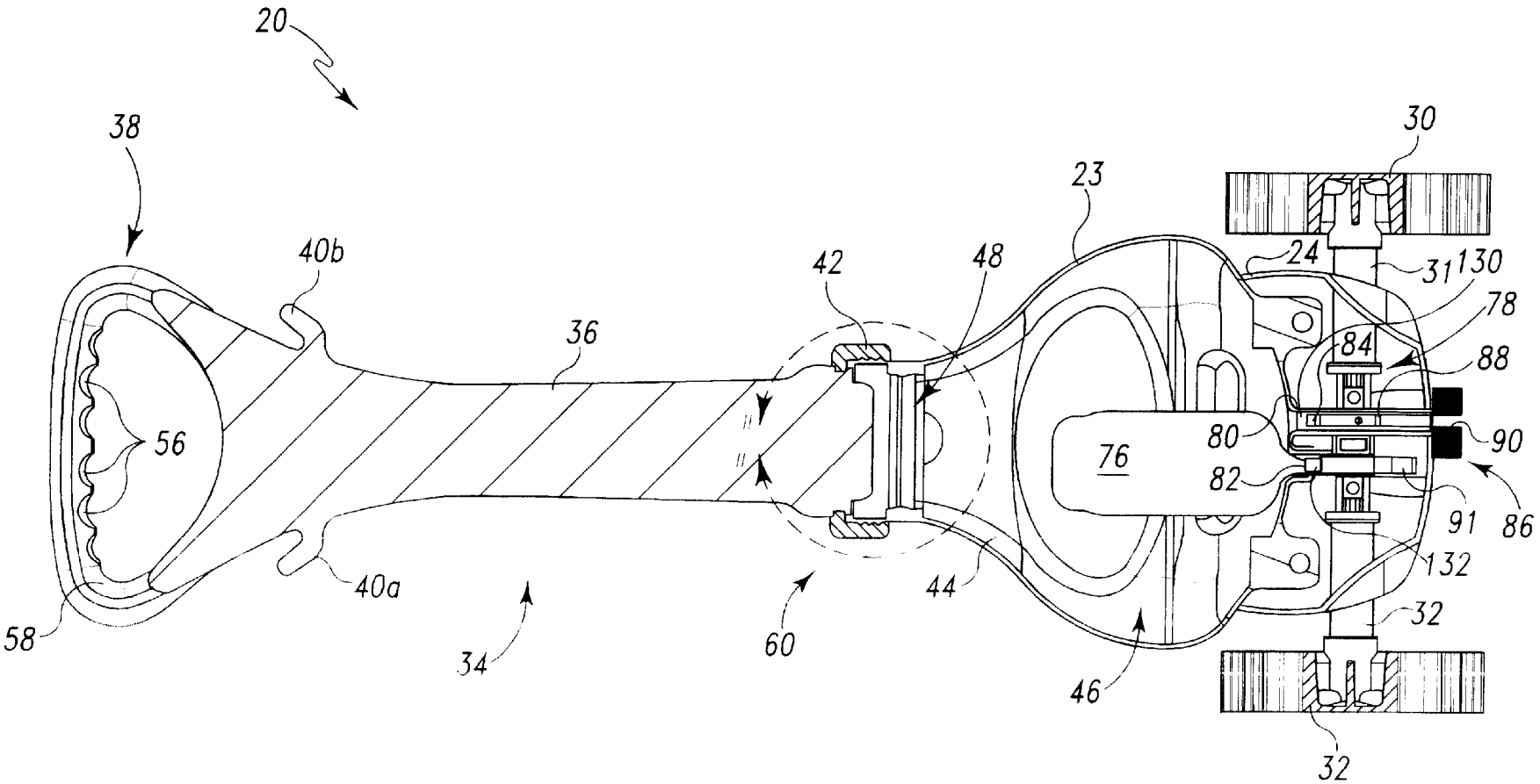
FIG. 2 is a sectional view of the pressure sprayer of FIG. 1 taken along line 2—2 thereof particularly showing a bottom half view.

With additional reference to FIG. 2, the pressure sprayer 20 further includes a handle assembly 34 that is removably attached to the body 22 via a threaded joining ring 42. The handle assembly 34 is preferably formed of a solid plastic and is predominantly defined by a shaft 36 that terminates at one end in a grip 38, and at the other end in an interface 60. Two sprayer hose clips 40*a* and 40*b* extend from opposite sides of the shaft 36 while a spray wand storage area 54 (see FIG. 1) is located on the shaft 36 proximate the grip 38. The grip 38 is preferably formed with a plurality of finger recesses 56 in an arch portion 58 thereof for the receipt of fingers of a user.

The interface 60 is adapted/configured to be received in and releasably retained on the tank portion 23. The tank portion 23 defines an internal cavity, tank, reservoir or the like 46 that is adapted to hold a liquid for dispensing. A neck 44 is formed on one end of the tank portion 23 and defines an opening 48 through which the liquid is received into the tank 46. The interface area 60 forms a cap or cover for the tank 46.

Figure 11:
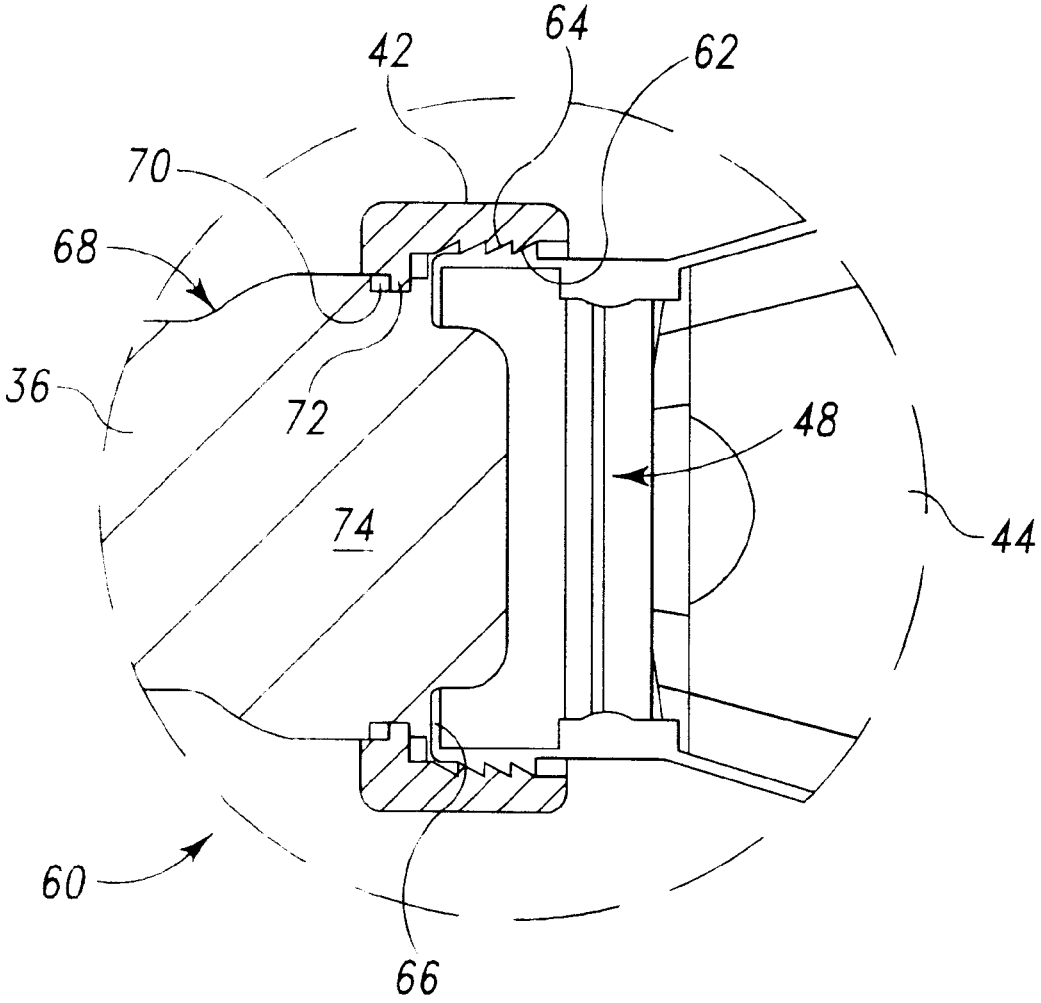
FIG. 11 is an enlarged sectional view of the handle assembly/tank interface area taken along circle 11—11 of FIG. 2.

With additional reference to FIG. 11, the interface 60 of the shaft 36 as it is releasably received onto the neck 44 of the tank portion 23 is shown in enlarged detail. The neck 44 defines the opening 48 by terminating in an essentially annular flange 66. The shaft 36 includes an enlarged or bulbous portion 68 that has a reduced diameter knob 74 sized to be received and extend into the opening 48 defined by the annular flange 66. The neck 44 further includes external threads 62 that threadedly mate with internal threads 64 of the joining ring 42. Preferably, the joining ring 42 is coupled to the bulbous portion 68 of the shaft 36 in a manner that allows the joining ring 42 to freely rotate. In particular, the bulbous portion 68 includes a circumferential groove or slot 70 that receives an annular flange 72 of the joining ring 42. Once the knob 74 is received into the opening 48, the joining ring 42 is threaded onto the threads 62 of the neck 44 and tightened. This releasably couples the handle assembly 34 to the body 22 and seals the tank 46.

Referring back to FIG. 2, the tank 46 is in communication with a pump 78 via outlet 80. The outlet 80 includes a filter 84 and allows liquid within the tank 46 to enter the pump 78 for eventual spraying, and also to a drain 86 should it be desired to remove (e.g. drain) the contents of the tank 46. The drain 86 includes a conduit 90 that is fitted with a plug 88. When the conduit 90 and plug 88 are in the position shown in FIG. 2, any liquid within the tank 46 will not flow out of the conduit 90 but be drawn into the pump 78 when the pump 78 is active. When the drain 86 is pulled out, the plug 88 does not hold back the liquid and it is allowed to exit via conduit 90 to the environment.

Internal to the tank 46 is a pressure accumulator 76 that is threadedly coupled to an outlet/inlet 82 and sealed with an O-ring. The pressure accumulator 76 receives liquid from the tank 46 via the pump 78 when the pump 78 is pumping and there is little to no spraying occurring. As the accumulator 76 fills with liquid, the pressure therein increases tending to force out the liquid. When the pump 78 is not pumping, the liquid under pressure within the accumulator 76 may be sprayed. The liquid exits the pump 78 via an exit nozzle 91. Once the pressure within the accumulator 76 is exhausted, the pump 78 needs to pump again to recharge the accumulator 76.

Figure 3:
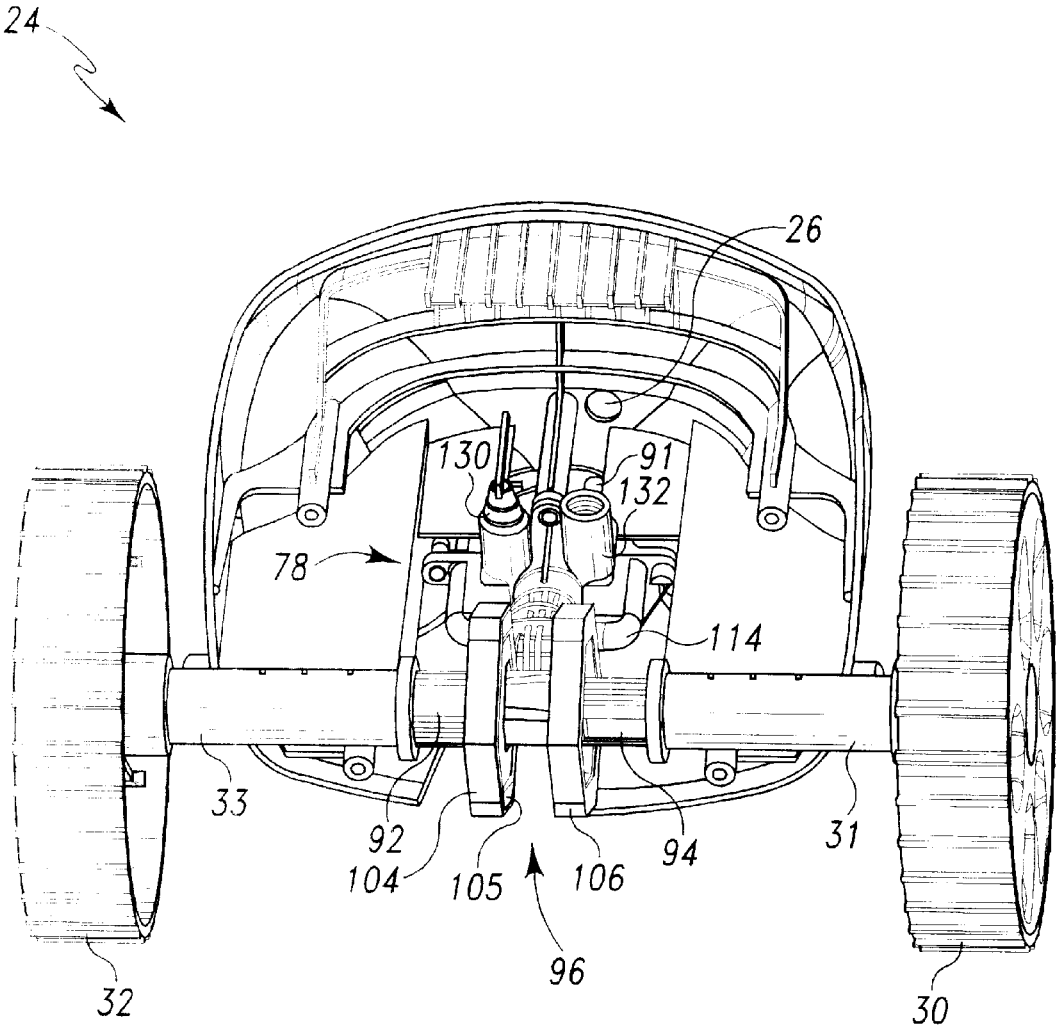
FIG. 3 is a sectional view of the bottom portion of the sprayer body particularly showing the pump and wheel drive assembly coupled to the pump.
Figure 4:
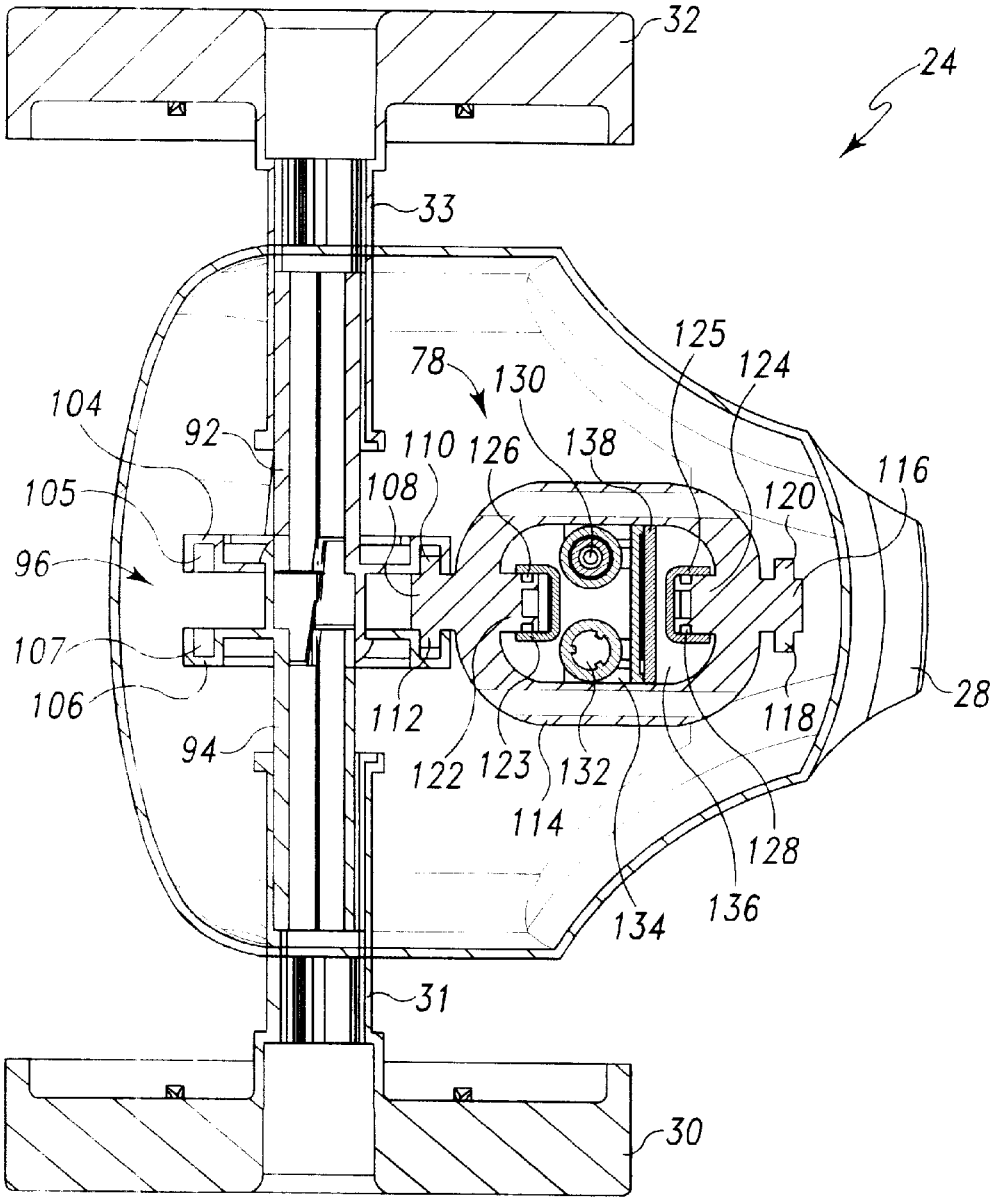
FIG. 4 is a sectional view of the lower half of the bottom portion of the sprayer body showing the pump in sectional and the wheel drive assembly in sectional coupled to the pump.

With reference to FIGS. 3 and 4, the pump 78 is caused to pump via action or movement of the wheels 30 and 32 as the pressure sprayer 20 is moved or wheeled from place to place. The wheel 30 includes a hub or sleeve 31 that extends over an axle portion 94 that connects to an axle portion 92. The wheel 32 includes a hub or sleeve 33 that extends over the axle portion 92. A cam assembly 96 comprising a cam portion 104 and a cam portion 106 is situated on the axles 92 and 94 respectively. The cam portion 104 includes a cam track 105 that faces a cam track 107 in the cam portion 106. Both cam tracks 105 and 107 are hexagonal shaped.

Figure 12:
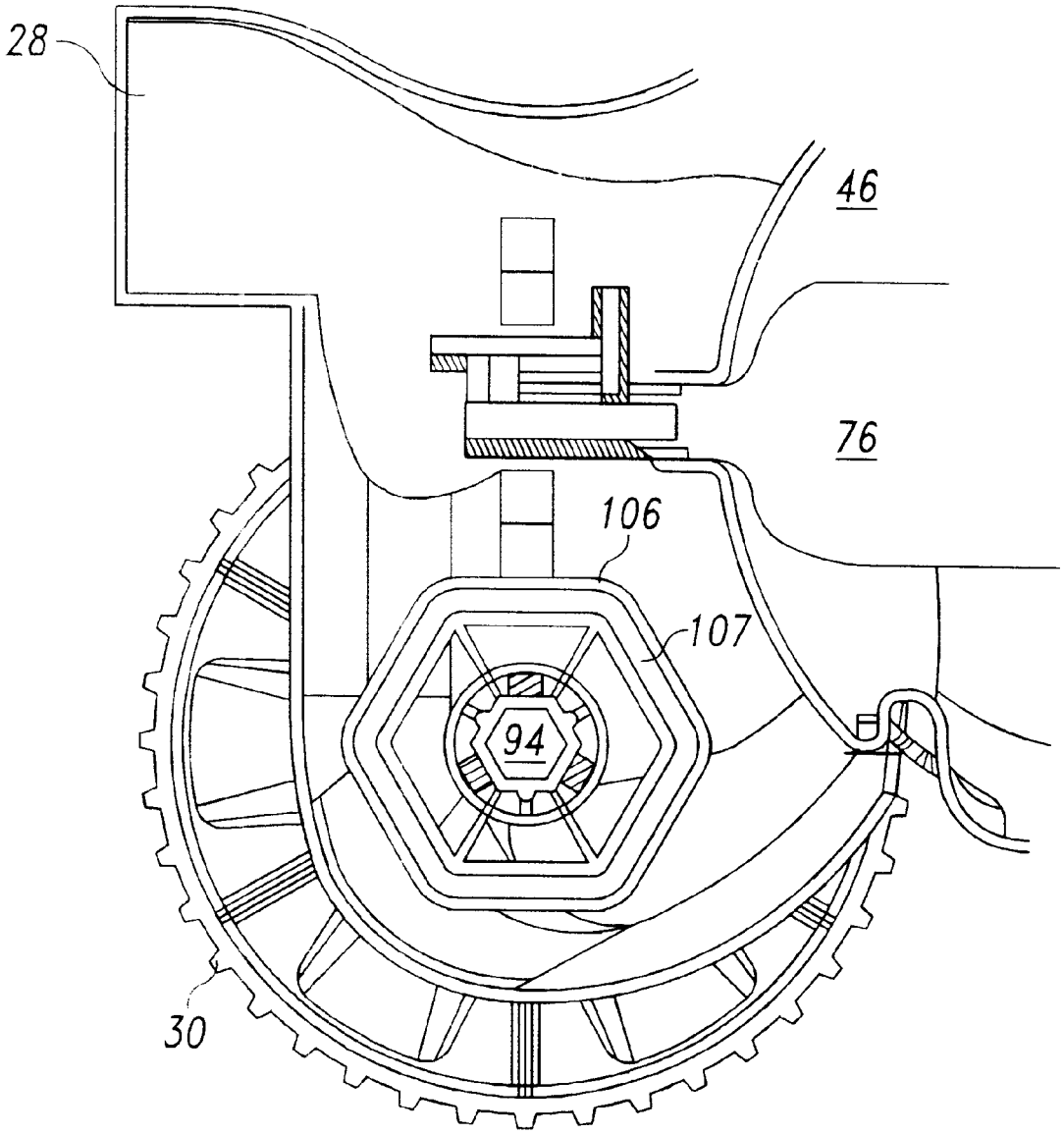
FIG. 12 is an enlarged view of a cam track of a cam portion of a cam assembly in accordance with the principles of the present invention.

In FIG. 12, the cam portion 106 is depicted particularly showing the cam track 107 thereof. The cam track 107 mirrors the cam track 105 of the cam portion 104 and coacts therewith to provide a hexagonal cam track for the drive pins 110 and 112 of the pump 78 (see FIG. 5). Particularly, the cam track 107 receives drive pin 112 while the cam track 105 receives drive pin 110 (see FIG. 4) each drive pin extending from a shaft 108 coupled to the yoke 114. Because of the configuration of the cam tracks 105 and 107, the drive pins 110 and 112, and thus the yoke 114 of the pump 78 is caused to reciprocate as represented by the arrow 98 in FIG. 5, causing the pump 78 to pump as described below.

While each of the cam tracks 105, 107 is described as possessing a hexagonal shape, it should be appreciated that each of the cam tracks 105, 107 may possess a shape other than a hexagonal shape and still achieve many of the benefits of the present invention. For example, each of the cam tracks 105, 107 may possess an octagonal shape.

Figure 5:
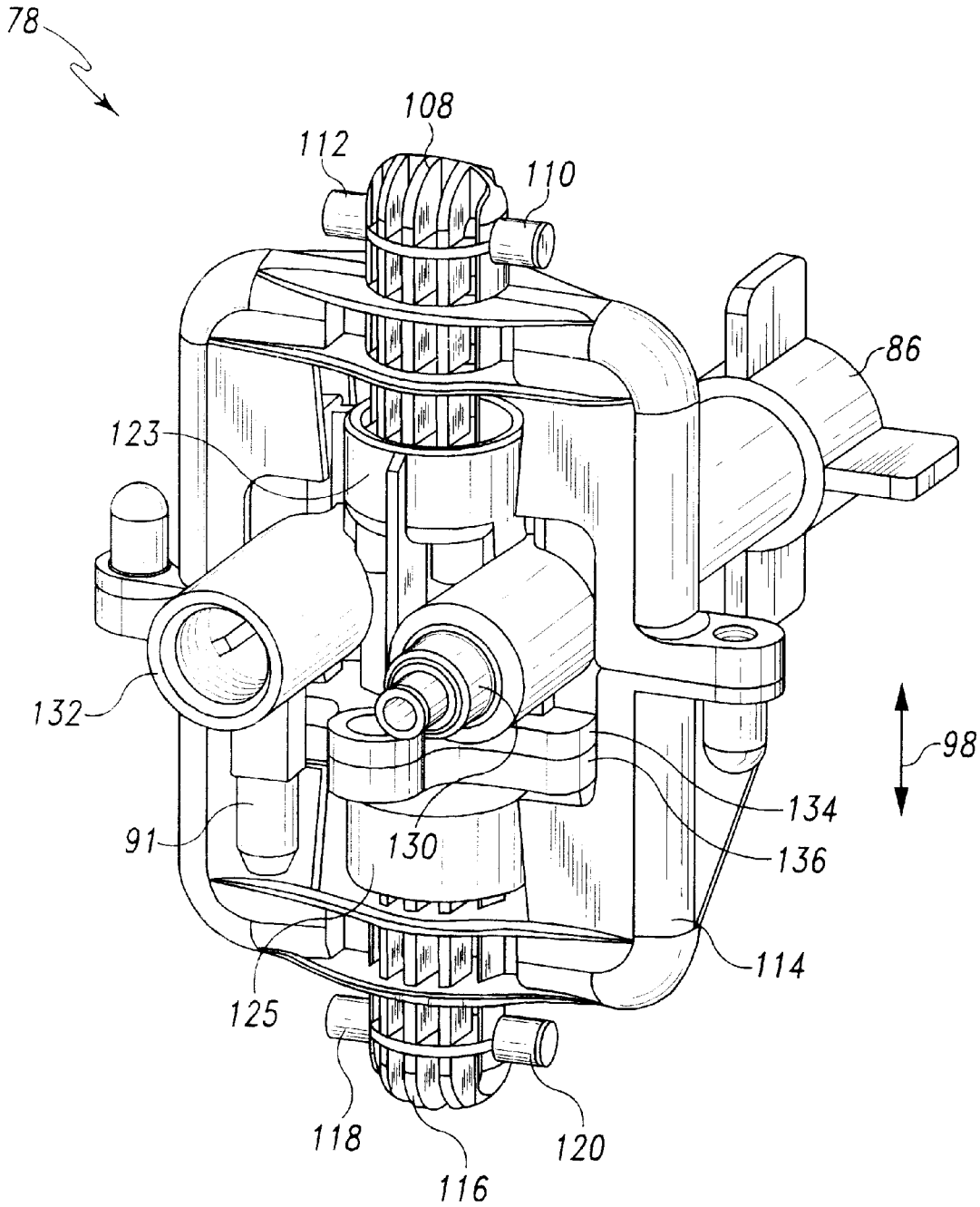
FIG. 5 is a perspective view of the pump used in the pressure sprayer of FIG. 1.

Referring back to FIGS. 3 and 4, and with additional reference to FIG. 5, as the wheels 30 and 32 turn, rotate or revolve under action of movement of the pressure sprayer 20, the cam assembly 96 rotates therewith, thereby rotating the cam tracks 105 and 107. As the drive pins 110 and 112 are constrained to follow the respective cam tracks 105 and 107, the yoke 114 is caused to move back and forth (i.e. reciprocate). The piston 122 having an O-ring 126 reciprocates in piston cylinder/housing 123 while the piston 124 having an O-ring 128 reciprocates in piston cylinder/housing 125. As one piston creates suction the other piston creates compression during reciprocation.

The pump 78 pictured in FIG. 5 also includes drive pins 118 and 120 extending from shaft 116. The shaft 116 is attached to the yoke 114 and thus moves with the movement of the yoke. This configuration allows the pump 78 to be installed in a different configuration and be driven by the drive pins 118 and 120 in the same manner as the drive pins 110 and 112 attached to shaft 108.

Figure 6:
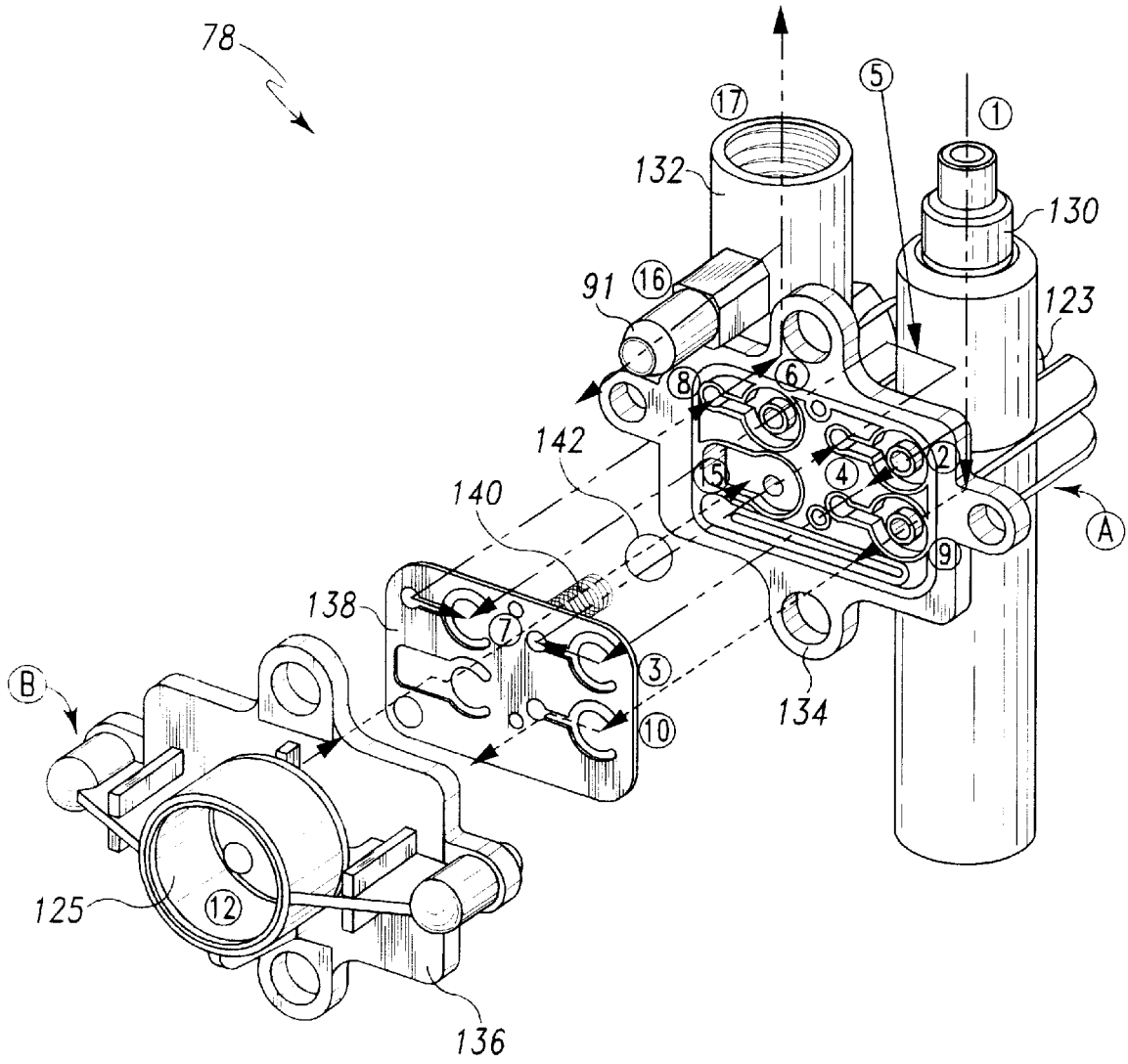
FIG. 6 is an exploded view of one side of the pump of FIG. 5 and its corresponding valve plate, particularly for describing pump operation.

With reference now to FIG. 6 the operation of the pump 78 will be described. The numbers within circles in FIG. 6 are referred to herein as "circle #". Liquid within the tank 46 is gravity fed to the pump 78 via inlet 130 (circle 1). As the wheels 30 and 32 are rotated, the "A" side draws the liquid through the port (circle 2) pushing the switching valve (circle 3) of the valve plate 138 out of the way. The liquid then flows through the port (circle 4) and into the piston cylinder 123. As the piston 122 begins the compression stroke, liquid is passed through the port (circle 6) pushing switching valve (circle 7) out of the way to allow the liquid to flow to port (circle 8) and into the pressure side ("B") of the pump 78. In the pressure side of the pump 78, the liquid can either discharge via the outlet nozzle 91 (circle 16) or flow to the pressure accumulator 76 via the outlet 132 (circle 17) for later use. The switching valves (circle 3 and circle 7) ensure that the liquid only flows in one direction, allowing the pump 78 to operate at peak efficiency.

Figure 7:
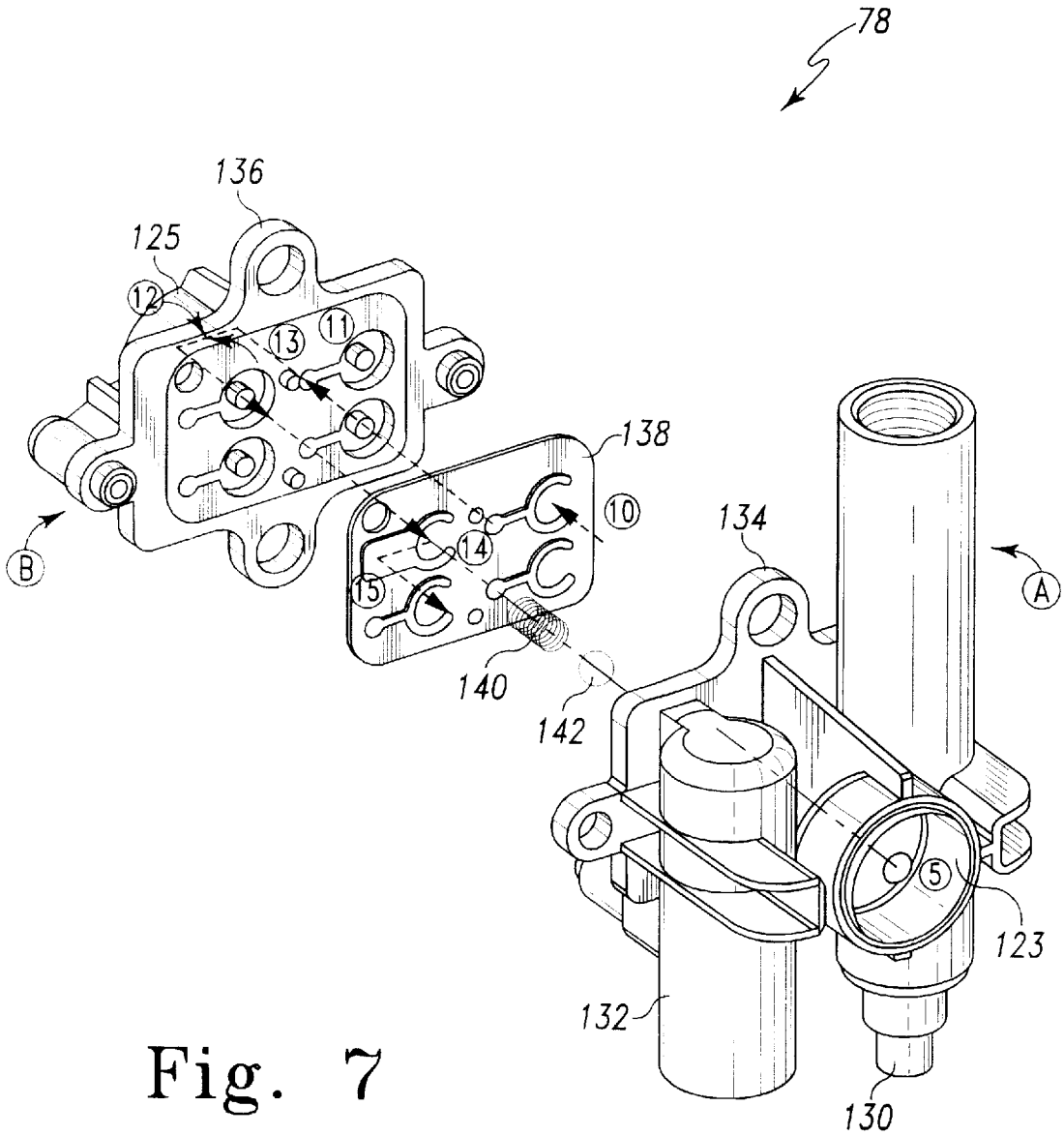
FIG. 7 is an exploded view of another side of the pump of FIG. 5 and its corresponding valve plate, particularly for describing pump operation.

With reference to FIG. 7, the "B" side of the pump 78 will be described. The "B" side of the pump 78 operates in essentially the same manner as the "A" side but the timing is exactly opposite thereof (i.e. 180° out of phase). When the "A" side is drawing in liquid, the "B" side is expelling liquid, due to the cam/pump/yoke stagger. The "B" side draws liquid from the tank 46 and passes the liquid through the port (circle 9) pushing the switching valve (circle 10) out of the way. Thereafter, the liquid flows through the port (circle 11) and into the piston cylinder 125 (circle 12). As the "B" side begins the compression stroke, while the "A" side is drawing liquid, the liquid in the "B" side is passed through the port (circle 13) and into the pressure side of the pump. In the pressure side of the pump, the liquid can either discharge via port 91 (circle 16) or flow to the pressure accumulator 76 (via circle 17) for later use. In FIGS. 6 and 7, circles 1, 16, and 17 are common channels use by both the "A" and "B" sides of the pump 78.

Figure 8:
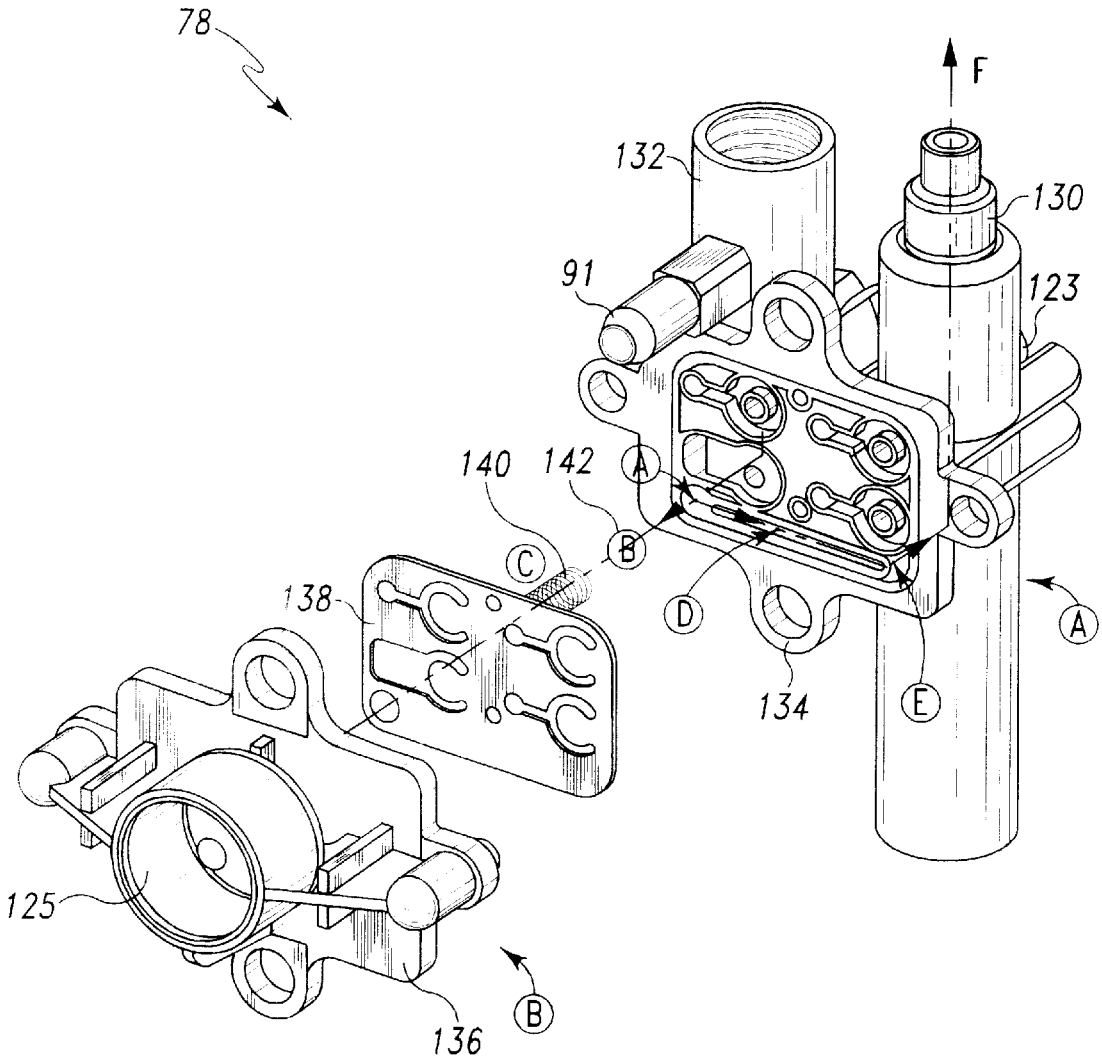
FIG. 8 is an exploded view of the pump and valve plate of FIG. 5 and its pressure relief valve, particularly for describing operation of the pressure relief valve.

With particular reference now to FIG. 8 there is depicted a pressure relief valve utilizing spring 140 and ball 142. The pressure relief valve (PRV) helps prevent excessive pressure buildup within the unit that might make the unit difficult to push or could damage the unit. The present PRV is designed to release pressure on the pressure side of the pump when the pump pressure exceeds 35–45 psi. When this pressure is reached, liquid pushes through port A, moving ball 142 ("B") out of the way by compressing spring 140 ("C"). The liquid can then flow through channel D, through port E, and back to the supply line of the pump via channel F. The pressure passed back to the supply line via this route is safely vented, allowing easy push/pull of the unit without causing damage to the pump 78.

Figure 9:
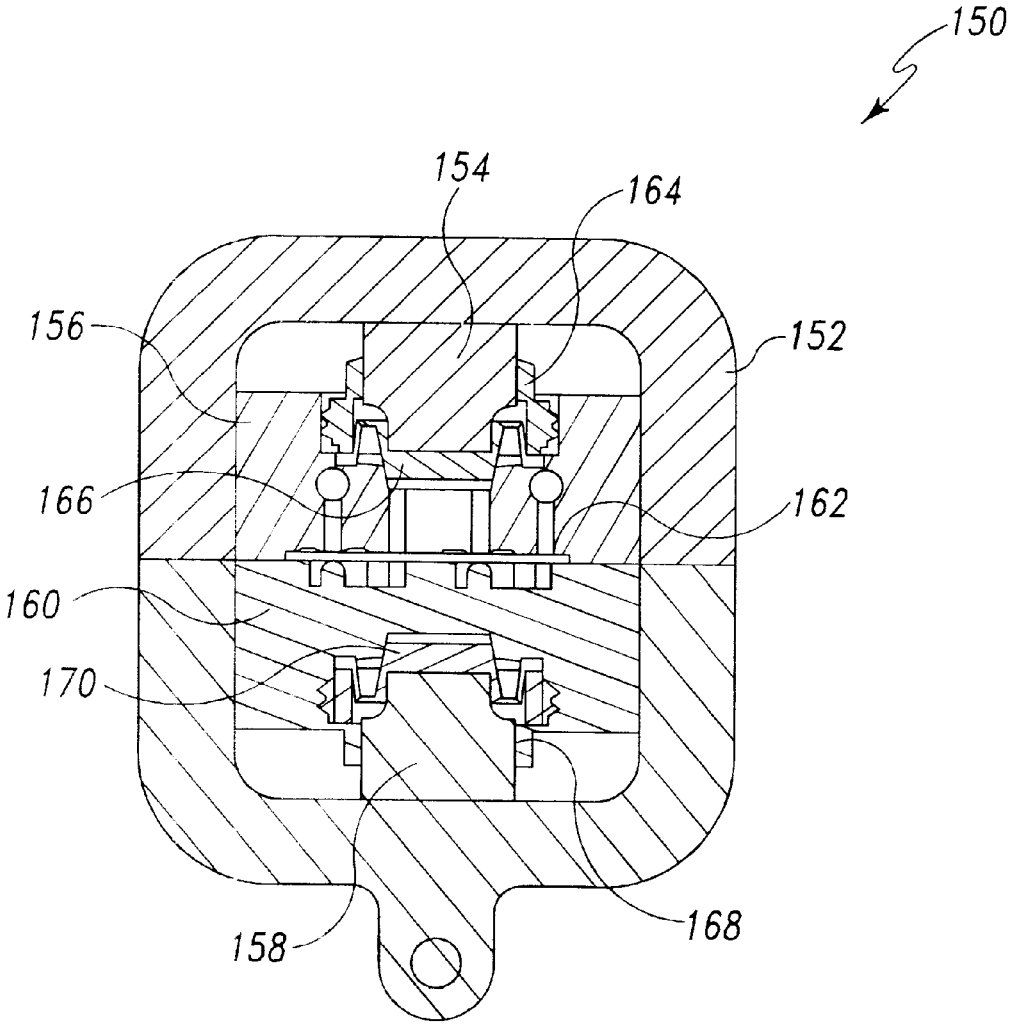
FIG. 9 is a sectional view of an alternative embodiment of a pump.

In FIG. 9 there is depicted a sectional view of an alternate embodiment of a pump 150. The pump 150 includes the same inlets and outlets as the pump 78. The present pump 150 however, is known as a diaphragm pump rather than the O-ring pump 78. It should be appreciated that either pump may be used in the pressure sprayer 20 as well as other pumps not shown and described herein. The pump 150 includes a reciprocatable yoke 152 that surround pump blocks 156 and 160 which are stationary with respect to the yoke 152. The yoke 152 includes a piston 154 that extends into the block 156 and is surrounded by a diaphragm sealing cap 164. A diaphragm overmold 166 is positioned at the end of the piston 154. The yoke 152 further includes a piston 158 that extends into the block 160 and is surrounded by a diaphragm sealing cap 168. A diaphragm overmold 170 is positioned at the end of the piston 158. Disposed between the various chambers and passages of the blocks 156 and 160 is a valve plate 162.

In this manner alternating suction and compression is produced by the pistons 154 and 158 due to the reciprocating motion of the yoke 152 as the wheels/cam assembly of the pressure sprayer rotates.

Figure 10:
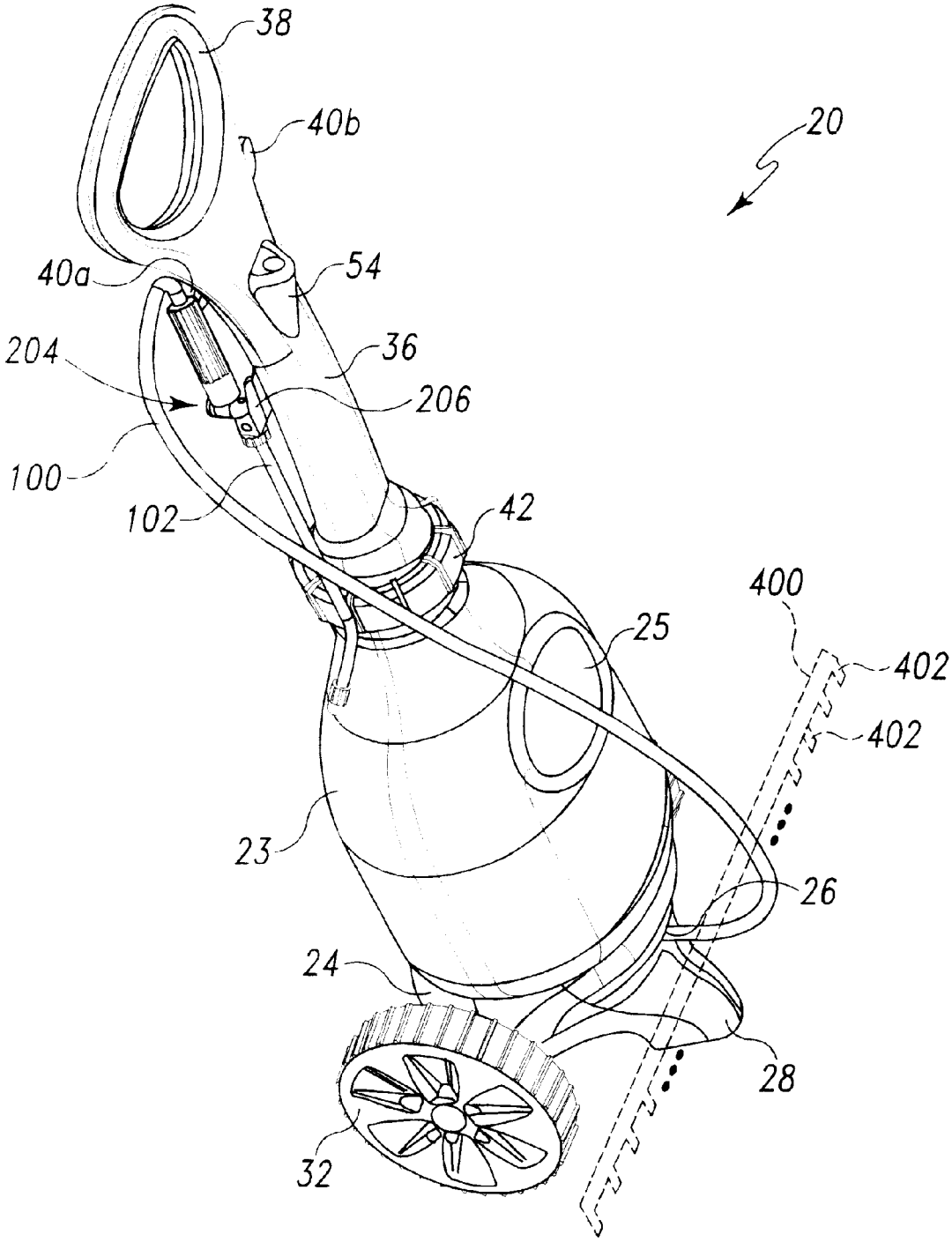
FIG. 10 is top perspective view of an embodiment of the present pressure sprayer having a hose and spray wand attached thereto.

Referring to FIG. 10, there is shown pressure sprayer 20 with a hose 100 extending through hose bore 26 and coupled to the nozzle 91 (see e.g. FIG. 6). Attached to the hose 100 is a spray wand 102 as is conventionally known in the art. The spray wand 102 is shown in FIG. 10 releasably mounted on hook 40*a*. As is well know in the art, the spray wand 102 includes a valve 204 having a control lever 206 (see FIG. 10).

While this invention has been described as having a preferred design, the present invention can be further modified within the spirit and scope of this disclosure. This application is therefore intended to cover any variations, uses, of adaptations of the invention using its general principles. Further, this application is intended to cover such departures from the present disclosure as come within known or customary practice in the art to which this invention pertains and which fall within the limits of the appended claims.

Figure 13:
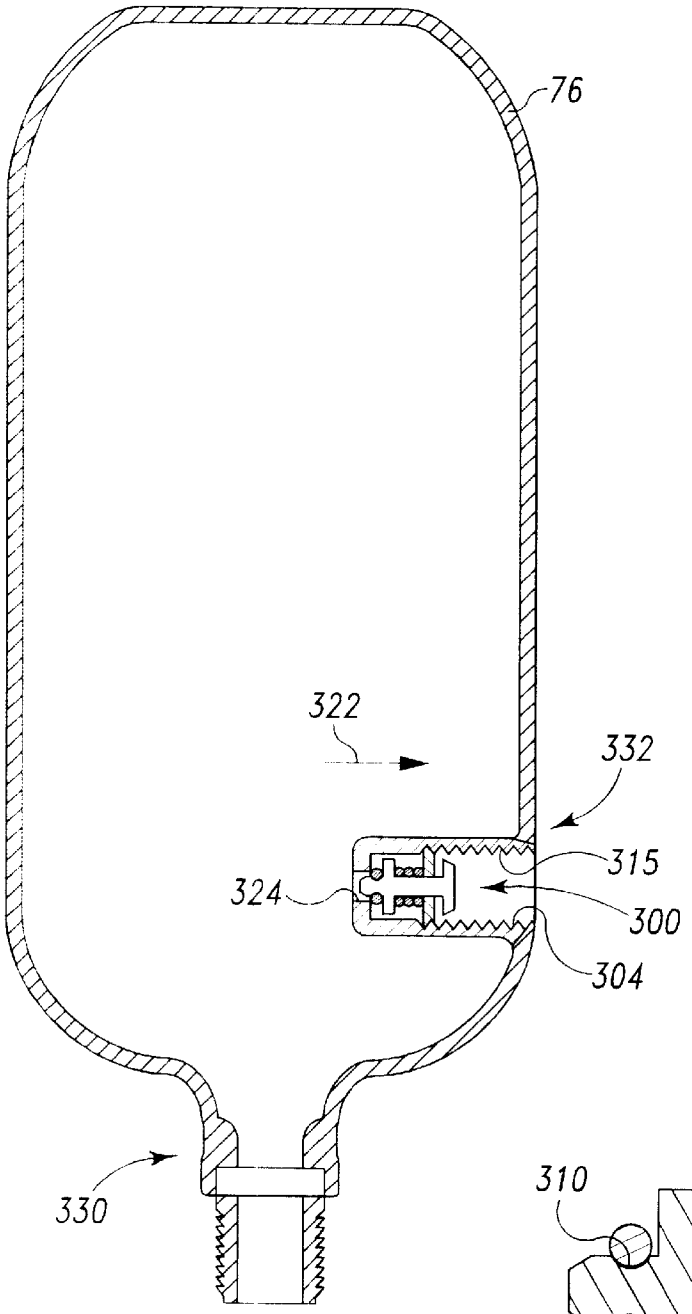
FIG. 13 is a sectional view of a pressure accumulator of the pressure sprayer of the of FIG. 1 showing an alternative arrangement for implementation of the pressure relief valve into the pressure sprayer of FIG. 1.
Figure 14:
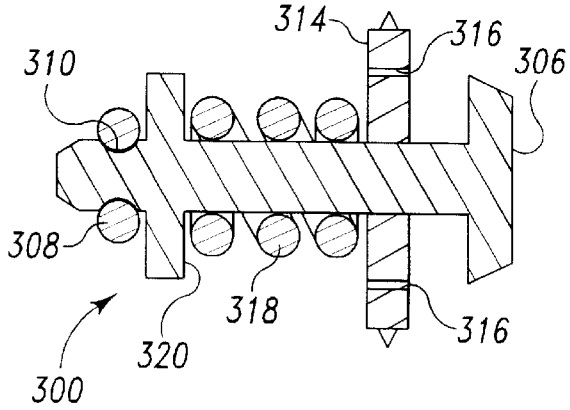
FIG. 14 is a sectional view of the pressure relief valve of FIG. 13.

For example, it is possible to modify the design of the pump 78 of FIGS. 2–8 so that it does not possess a pressure relief valve therein. Rather, a pressure relief valve 300 can be coupled directly to a sidewall of the pressure accumulator 76 as shown in FIG. 13. In particular, in such a modification, the pressure relief valve 300 is located in a recess 304 defined in a sidewall of the pressure accumulator 76. The pressure release valve 300 includes a plunger 306 as shown in FIG. 14. An elastomeric O-ring 308 is positioned around a lower portion of the plunger 306 and is located in a groove 310 defined in the plunger 306 as shown in FIG. 14. A threaded retainer 314 is positioned around an upper portion of the plunger 306. The retainer 314 possesses a substantially annular configuration. The retainer 314 includes a number of channels 316 defined therein so as to allow fluid to flow through the retainer 314. The retainer 314 is threadingly received by a complementary threaded portion 315 defined in the sidewall of the pressure accumulator 76 at a location within the recess 304 (see FIG. 13). A spring 318 is positioned around the plunger 306 and interposed between the retainer 314 and a flange portion 320 of the plunger 306.

During operation, if pressure within the pressure accumulator 76 exceeds a certain value (e.g. 35–45 psi), liquid pushes the plunger 306 in the direction of arrow 322 (see FIG. 13) against the spring bias of the spring 318. This movement of the plunger 306 causes O-ring 308 to become unseated so that liquid flows through a port 324 defined in the sidewall of the accumulator 76. Once liquid flows through port 324, it advances around the plunger 306 and the spring 318, and then though the channels 316 defined in the retainer 314, and thereafter advances to a location outside of the pressure accumulator 76. Liquid advances in such a manner until pressure within the pressure accumulator 76 diminishes to a certain value such that the spring bias of spring 318 can urge the O-ring 308 back to its seated position in contact with the sidewall of the accumulator 76 as shown in FIG. 13 whereby fluid flow through the port 324 is occluded.

The above-identified design could be further modified by providing the pressure relief valve 300 at a neck portion 330 of the pressure accumulator 76, as opposed to an intermediate sidewall portion 332 as shown in FIG. 13. Obviously, the neck portion 330 would have to be modified to possess the width and length sufficient to accommodate the pressure relief valve 300.

Figure 15:
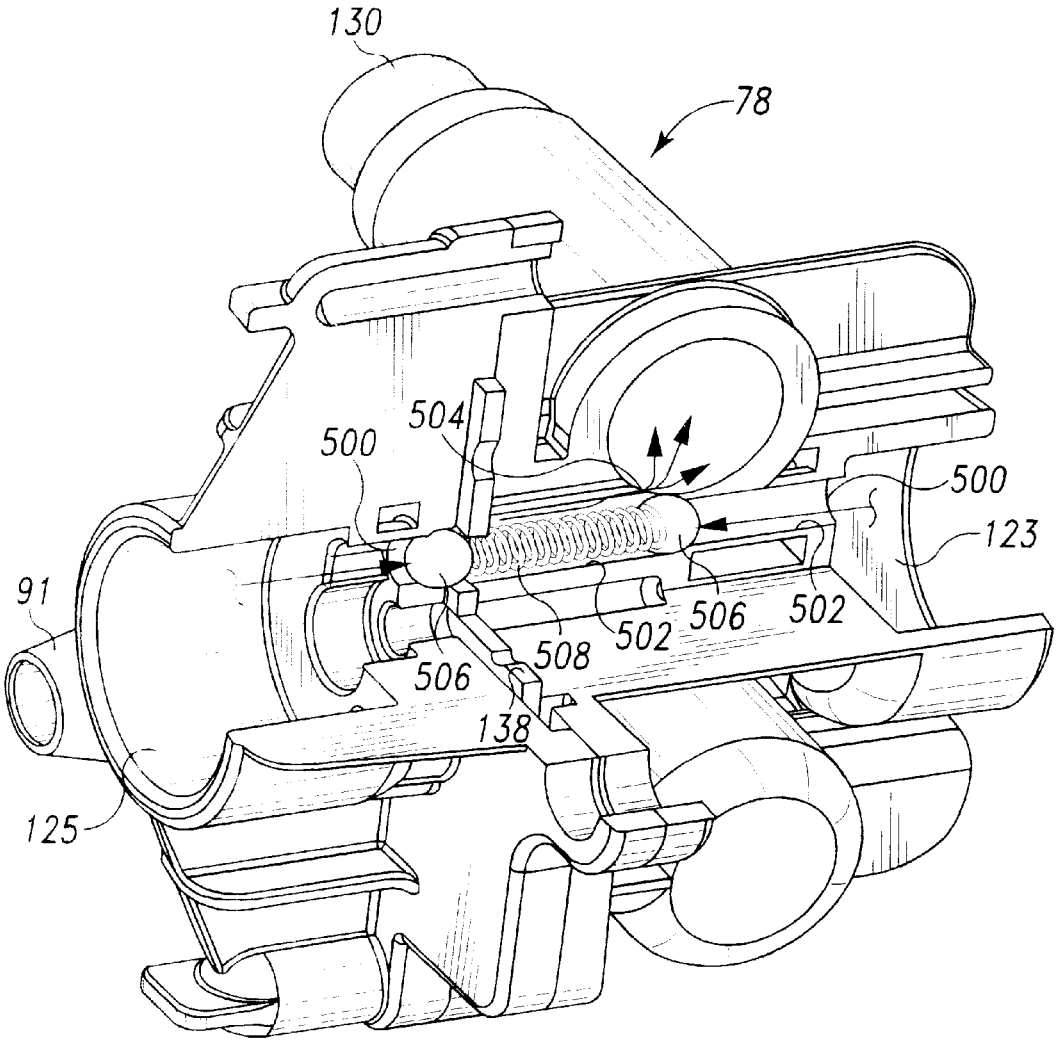
FIG. 15 is a fragmentary view of the pump of the pressure sprayer of FIG. 1 showing yet another arrangement for implementation of the pressure relief valve into the pressure sprayer of FIG. 1.

Another modification of the pump 78 of FIGS. 2–8 which is possible is to alter the configuration of the pump so that the pressure relief flow path as shown in FIG. 8 does not exist but rather a new pressure relief flow path exists as shown in FIG. 15. In particular, each of the piston housings 123, 125 would possess a port 500 which leads to a channel 502 defined within the housing of the pump 78. In turn, the channel 502 is in fluid communication with another port 504 defined in the housing of the pump 78 which leads to the supply line of the pump 78. Thus, during operation, when a certain pressure is reached within each of the piston housings 123, 125, liquid advances through the respective port 500 thereby moving a respective ball 506 out of the way by compressing a spring 508. Liquid can then flow through the ports 500, the channel 502, and the port 504 and then back to the supply line of the pump 78 as shown by the arrows in FIG. 15. In this manner, excess pressure is safely vented back to the supply line of the pump thereby facilitating easy pushing and pulling of the pressure sprayer 20 and avoiding damage to the pump due to overpressurization of the accumulator 76.

Figure 16:
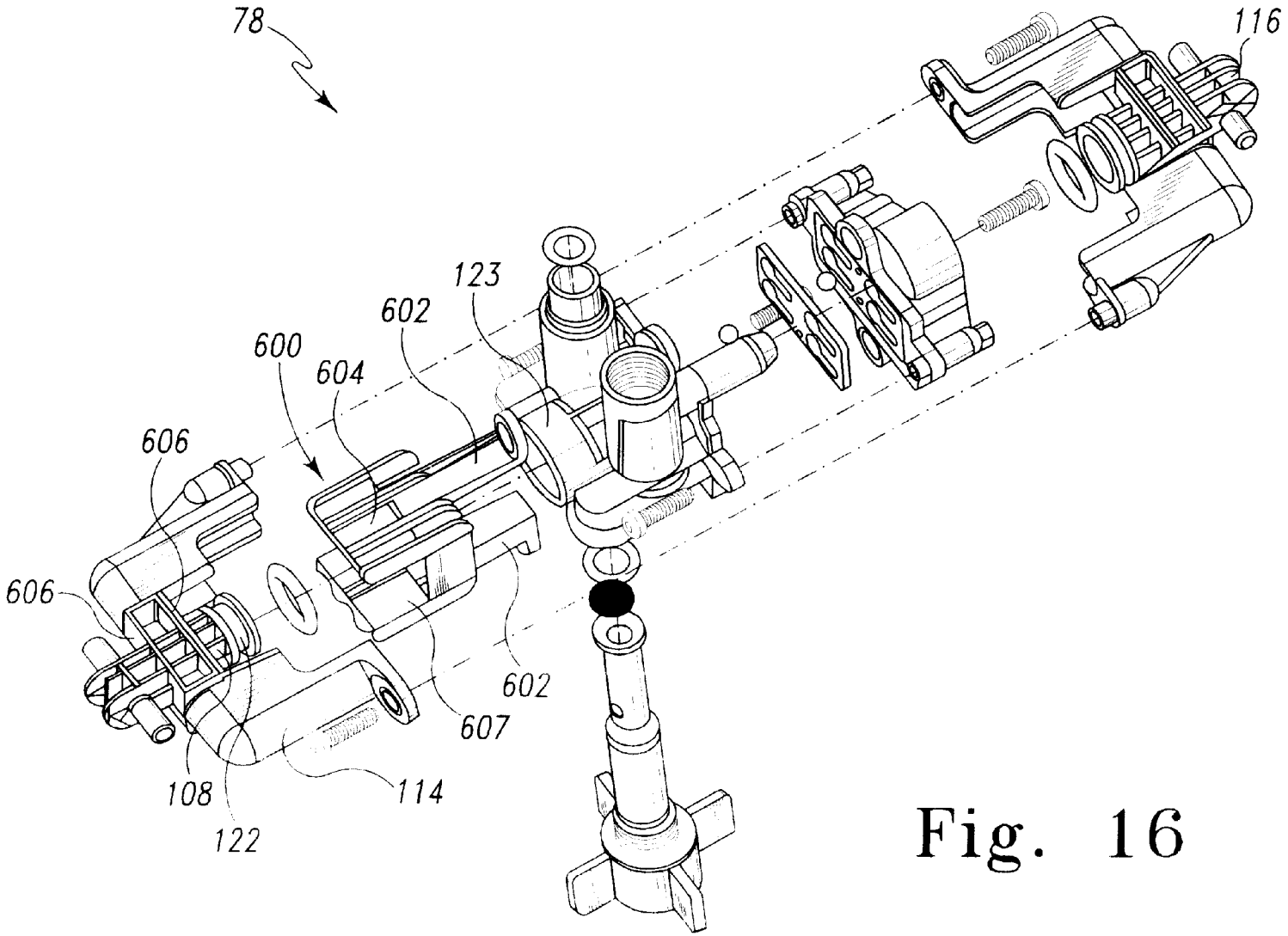
FIG. 16 is an exploded view of the pump of the pressure sprayer of FIG. 1 showing the manner of attachment of a support and guide bracket to the pump in an alternative embodiment of the present invention.
Figure 17:
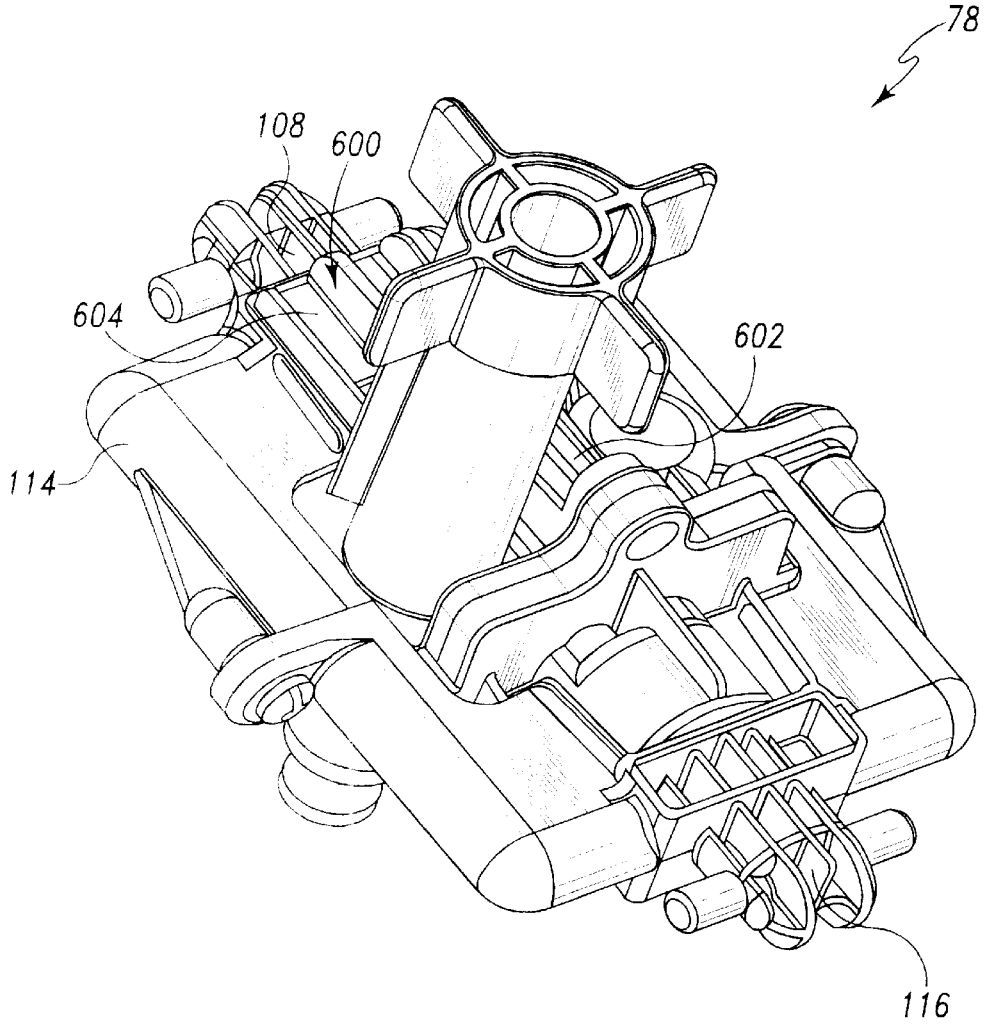
FIG. 17 is an assembled elevational view of the bracket and pump of FIG. 16 shown positioned at a first orientation.
Figure 18:
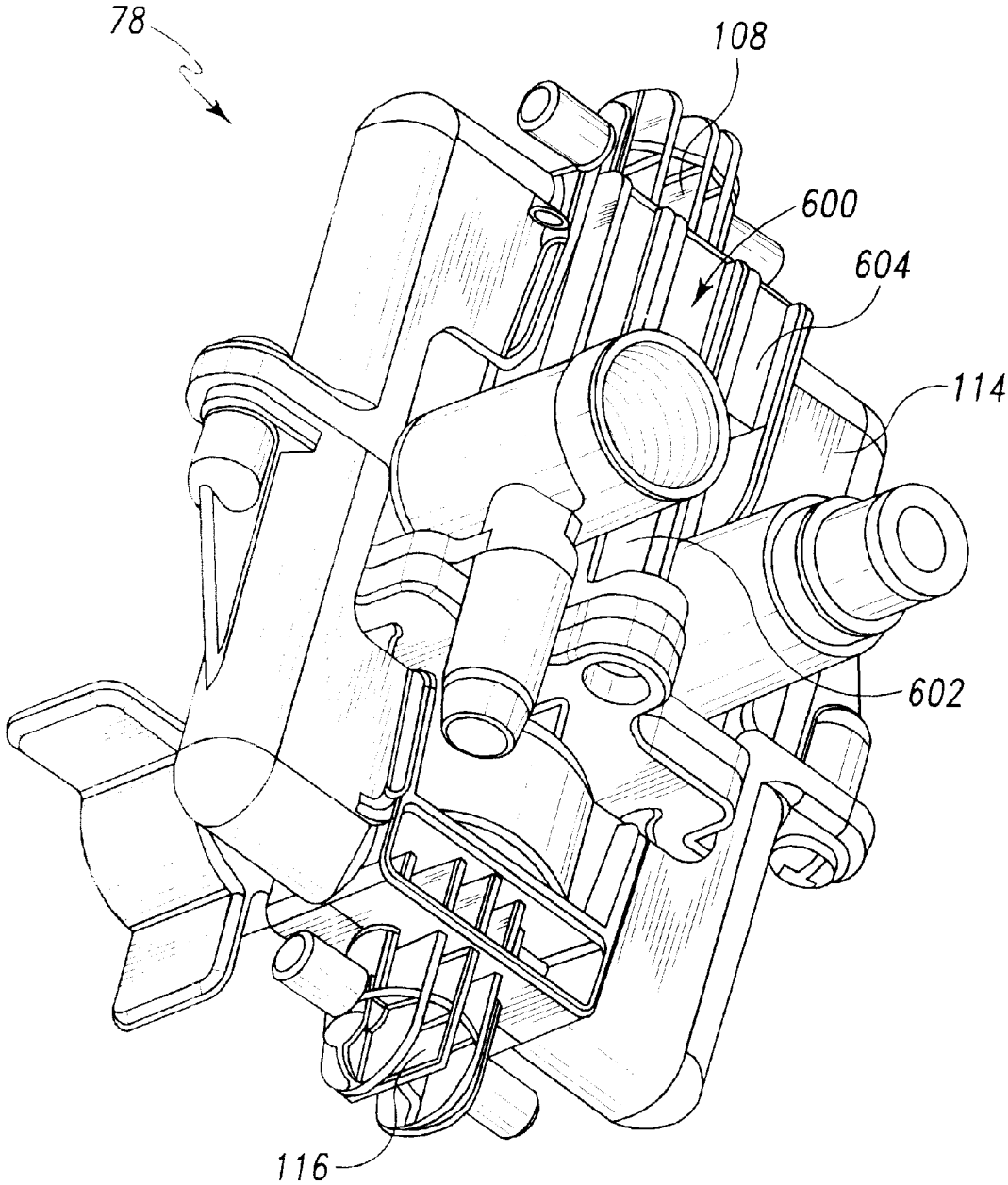
FIG. 18 is an assembled elevational view of the bracket and pump of FIG. 16 shown positioned at a second orientation.

Yet a further modification of the pump 78 of FIGS. 2–8 which is possible is to provide a bracket 600 which is secured to the outside of the housing of the pump 78 as shown in FIGS. 16–18. The bracket 600 includes a pair of legs 602 extending outwardly from a main body portion 604 as shown in FIG. 16. When secured to the housing of the pump 78 as shown in FIGS. 16–18, the bracket 600 functions to guide the piston shaft 108 during reciprocation thereof. In particular, when the bracket 600 is secured to the housing of the pump 78, and the piston shaft 108 is reciprocating, a pair of ribs 606 which are attached to the piston shaft 108 slidingly contact an inner surface 607 of the main body portion 604 so as to help guide the piston 122 within the piston housing 123. Note that while it is possible to provide a bracket 600 on each side of the pump so as to help guide both pistons 122, 124 within its respective piston housing 123, 125, in the preferred embodiment only one bracket is provided to help guide the piston 122 within the piston housing 123. Note that this bracket 600 is provided on the axle side of the pump (i.e. the side of the pump 78 which is closest to the axle portions 92 and 94—see FIG. 4). It should be appreciated that a significant amount of torque is transferred through the pump 78 during operation of the pressure sprayer 20. The bracket 600 helps support the yoke 114 including the piston shaft 108 from deflecting or otherwise deforming during such operation.

Moreover, it is possible to modify the pressure sprayer 20 (see FIG. 10) so that the hose 100 is in fluid communication with a boom assembly 400 (shown in phantom in FIG. 10), as opposed to the spray wand 102. The boom assembly 400 would function to receive the flow of liquid from the hose 100 and distribute the liquid to a plurality of nozzles 402 located along the length of the boom assembly 400. Of course, during operation, liquid flow to the boom assembly could be selectively actuated, via a valve mechanism (not shown), so that the liquid flow can occur at the desire of the user.

Moreover, it is further possible to modify the pressure sprayer 20 (see FIG. 10) so that the number of wheels possessed by the pressure sprayer is greater than or less than two. For instance, the sprayer may have three wheels which actuate the pump 78. Also, it is possible for the sprayer 20 to have only a single wheel which actuates the pump 78. In sum, Applicants' invention contemplates the use of any number of wheels.

Furthermore, it is possible to modify the pressure sprayer 20 of FIGS. 1–10 so that the pump 78 does not operate based on movement of a cam. For instance, the sprayer may be modified so that a gear mechanism (not shown) is interposed between the wheel axles 92, 94 and the pump 78. The gear mechanism would be operable to transfer force from the rotating wheel axles 92, 94 to the pump 78. In other words, operation of the pump 78 would be based on movement of at least one gear which is coupled to the wheel axle 92 or 94 (or both). Preferably, in this particular embodiment, a series of gears would be operable to transfer force from the rotating wheel axles 92, 94 to the pump 78.

There are a plurality of advantages of the present invention arising from the various features of the pressure sprayer described herein. It will be noted that alternative embodiments of the pressure sprayer of the present invention may not include all of the features described yet still benefit from at least some of the advantages of such features. Those of ordinary skill in the art may readily devise their own implementations of the pressure sprayer that incorporate one or more of the features of the present invention and fall within the spirit and scope of the present invention as defined by the appended claims.

What is claimed is:

1. A pressure sprayer, comprising:

a tank for holding fluid;

an accumulator for storing fluid therein under pressure;

a number of wheels for supporting said tank; and a pump which advances fluid from said tank into said accumulator in response to rotation of said number of wheels, wherein pressure within said accumulator is increased when fluid is advanced into said accumulator by said pump, further comprising a cam which moves in response to rotation of said number of wheels, wherein said pump advances fluid from said tank into said accumulator in response to movement of said cam.

2. The pressure sprayer of claim 1, wherein:

said pump includes a piston and a piston housing configured to receive said piston therein, and movement of said cam causes said piston to reciprocate in said piston housing.

3. The pressure sprayer of claim 2, wherein said piston includes a piston shaft, a drive pin is attached to said piston shaft, said cam defines a cam track in which said drive pin is positioned, and movement of said cam causes said drive pin to advance trough said cam track.

4. The pressure sprayer of claim 1, further comprising an axle extending between a first wheel and a second wheel of said number of wheels, said cam being mounted on said axle.

5. The pressure sprayer of claim 4, wherein:

rotation of said first wheel and said second wheel causes movement of said axle, and movement of said axle causes movement of said cam.

6. A pressure sprayer, comprising:

a tank for holding fluid;

an accumulator for storing fluid therein under pressure;

a number of wheels for supporting said tank; and a pump which advances fluid from said tank into said accumulator in response to rotation of said number of wheels, wherein pressure within said accumulator is increased when fluid is advanced into said accumulator by said pump, further comprising a hose in fluid communication with said accumulator, wherein (i) said hose has a valve mechanism coupled to one end thereof, and (ii) said valve mechanism includes a control lever for selectively actuating said valve mechanism.

7. A pressure sprayer, comprising:

an accumulator for storing fluid therein under pressure;

at least one wheel which rotates when said pressure sprayer is moved; and a pump which advances fluid into said accumulator in response to rotation of said at least one wheel, wherein an increased pressure is generated within said accumulator in response to fluid being advanced into said accumulator by said pump, and wherein said increased pressure within said accumulator is maintained when said at least one wheel is stationary, further comprising a tank configured to store liquid therein, wherein said pump advances fluid from said tank to said accumulator in response to rotation of said at least one wheel, and further comprising a cam which moves in response to rotation of said at least one wheel, wherein said pump advances fluid into said accumulator in response to movement of said cam.

8. The pressure sprayer of claim 7, wherein:

said pump includes a piston and a piston housing configured to receive said piston therein, and movement of said cam causes said piston to reciprocate in said piston housing.

9. The pressure sprayer of claim 8, wherein:

said piston includes a piston shaft, a drive pin is attached to said piston shaft, said cam defines a cam track in which said drive pin is positioned, and movement of said cam causes said drive pin to advance through said cam track.

10. The pressure sprayer of claim 7, further comprising an axle extending between a first wheel and a second wheel of said pressure sprayer, said cam being mounted on said axle.

11. The pressure sprayer of claim 10, wherein:

rotation of said first wheel and said second wheel causes movement of said axle, and movement of said axle causes movement of said cam.

12. A pressure sprayer, comprising:

an accumulator for storing fluid therein under pressure;

at least one wheel which rotates when said pressure sprayer is moved; and a pump which advances fluid into said accumulator in response to rotation of said at least one wheel, wherein an increased pressure is generated within said accumulator in response to fluid being advanced into said accumulator by said pump, and wherein said increased pressure within said accumulator is maintained when said at least one wheel is stationary, further comprising a hose in fluid communication with said accumulator, wherein (i) said hose has a valve mechanism coupled to one end thereof, and (ii) said valve mechanism includes a control lever.

13. A method of spraying fluid with a portable pressure sprayer having a tank, an accumulator, and a number of wheels, comprising the steps of:

moving said portable pressure sprayer so as to cause said number of wheels to rotate;

advancing fluid from said tank into said accumulator in response to rotation of said number of wheels;

generating an increased pressure within said accumulator in response to fluid being advanced into said accumulator;

maintaining said increased pressure within said accumulator after said moving step when said number of wheels are stationary; and advancing fluid from a first location within said accumulator to a second location outside of said sprayer while said number of wheels are stationary.

14. The method of claim 13, wherein:

said step of advancing fluid from said first location within said accumulator to said second location outside of said sprayer includes the step of spraying fluid through a hose, said hose has a valve mechanism coupled to one end thereof, and said valve mechanism includes a control lever.

15. A method of spraying fluid with a portable pressure sprayer having a tank, an accumulator, and a number of wheels, comprising the steps of:

moving said portable pressure sprayer so as to cause said number of wheels to rotate;

advancing fluid from said tank into said accumulator in response to rotation of said number of wheels;

generating an increased pressure within said accumulator in response to fluid being advanced into said accumulator; and maintaining said increased pressure within said accumulator after said moving step when said number of wheels are stationary, wherein said advancing step includes the step of pumping said fluid from said tank into said accumulator with a pump, and wherein (i) said pump includes a piston and a piston housing configured to receive said piston therein, and (ii) rotation of said number of wheels causes said piston to reciprocate in said piston housing.

16. A method of spraying fluid with a portable pressure sprayer having a tank, an accumulator, and a number of wheels, comprising the steps of:

moving said portable pressure sprayer so as to cause said number of wheels to rotate;

advancing fluid from said tank into said accumulator in response to rotation of said number of wheels;

generating an increased pressure within said accumulator in response to fluid being advanced into said accumulator; and maintaining said increased pressure within said accumulator after said moving step when said number of wheels are stationary, wherein said generating step includes the steps of (i) moving a cam in response to rotation of said number of wheels, and (ii) operating a pump in response to movement of said cam.

17. The method of claim 16, wherein:

said pump includes a piston and a piston housing, said operating step includes the step of reciprocating said piston within said piston housing, and said reciprocating step occurs in response to movement of said cam.

18. The method of claim 16, wherein said operating step includes the step of advancing fluid from said tank to said accumulator with said pump in response to movement of said cam.

19. The method of claim 18, wherein:

an axle is interposed between a first wheel and a second wheel of said number of wheels, and rotation of said axle causes movement of said cam.

20. A method of spraying fluid with a pressure sprayer having at least one wheel, comprising the steps of:

moving said portable pressure sprayer so as to cause said at least one wheel to rotate;

generating an increased pressure within said sprayer in response to rotation of said at least one wheel;

maintaining said increased pressure within said sprayer after said generating step when said at least one wheel is stationary; and advancing fluid from a first location within said sprayer to a second location outside of said sprayer after said generating step when said at least one wheel is stationary.

21. A method of spraying fluid with a pressure sprayer having at least one wheel, comprising the steps of:

moving said portable pressure sprayer so as to cause said at least one wheel to rotate;

generating an increased pressure within said sprayer in response to rotation of said at least one wheel; and maintaining said increased pressure within said sprayer after said generating step when said at least one wheel is stationary, wherein said generating step includes the steps of (i) moving a cam in response to rotation of said at least one wheel, and (ii) operating a pump in response to movement of said cam.

22. The method of claim 21, wherein:

said pump includes a piston and a piston housing, said operating step includes the step of reciprocating said piston within said piston housing, and said reciprocating step occurs in response to movement of said cam.

23. The method of claim 22, wherein:

said sprayer further has a tank and an accumulator, and said operating step includes the step of advancing fluid from said tank to said accumulator with said pump in response to movement of said cam.

24. The method of claim 23, wherein:

an axle is interposed between a first wheel and a second wheel of said sprayer, and rotation of said axle causes movement of said cam.

25. The method of claim 23, further comprising the step of releasing pressure from said accumulator in response to pressure within said accumulator exceeding a certain value.

* * * * *